US005299546A

United States Patent [19]

Kato et al.

[11] Patent Number: 5,299,546

[45] Date of Patent: Apr. 5, 1994

[54] AIR-FUEL RATIO CONTROL APPARATUS OF INTERNAL COMBUSTION ENGINE

[75] Inventors: Tatsunori Kato, Nagoya; Katsuhiko Kodama, Toyota; Masahiko Tajima, Takahama; Junya Morikawa, Kasugai, all of Japan

[73] Assignee: Nippondenso, Co., Ltd., Kariya, Japan

[21] Appl. No.: 52,926

[22] Filed: Apr. 27, 1993

[30] Foreign Application Priority Data

Apr. 28, 1992 [JP] Japan ..... 4-109592
Nov. 10, 1992 [JP] Japan ..... 4-299925

[51] Int. Cl.[5] ..... F02M 33/02
[52] U.S. Cl. ..... 123/520; 123/198 D
[58] Field of Search ..... 123/520, 521, 516, 518, 123/519, 198 D

[56] References Cited

U.S. PATENT DOCUMENTS

| | | | |
|---|---|---|---|
| 4,748,959 | 6/1988 | Cook | 123/520 |
| 4,831,992 | 5/1989 | Jundt | 123/520 |
| 4,967,713 | 11/1990 | Kojima | 123/520 |
| 4,977,881 | 12/1990 | Abe | 123/520 |
| 5,048,493 | 9/1991 | Orzel | 123/520 |
| 5,090,388 | 2/1992 | Hamburg | 123/520 |
| 5,143,040 | 9/1992 | Okawa | 123/520 |
| 5,188,085 | 2/1993 | Habaguchi | 123/520 |

FOREIGN PATENT DOCUMENTS 62-233466 10/1987 Japan .
2-130240 5/1990 Japan .

*Primary Examiner*—Carl S. Miller
*Attorney, Agent, or Firm*—Cushman, Darby & Cushman

[57] ABSTRACT

An air-fuel ratio control apparatus for an internal combustion engine for learning and controlling an air-fuel ratio accurately even during execution of purging of evaporated fuel. The evaporated fuel generated in a fuel tank is adsorbed to a canister, and the adsorbed fuel is evaporated and purged together with air to the intake side of the internal combustion engine through a purge valve. During normal purge rate control by the purge valve, air-fuel ratio feedback values detected by an oxygen sensor are averaged, and the concentration of the evaporated fuel taken into the internal combustion engine through the purge valve is detected by the deviation from a stoichiometric air-fuel ratio 1 of the averaged value and the purge rate. Further, after the lapse of a predetermined period of time after purging is started, air-fuel ratio learning values are renewed in accordance with the air-fuel ratio feedback value and stored in a RAM.

10 Claims, 14 Drawing Sheets

FULL ADMISSION PURGE RATE MAP (%)

| NE \ PM | 291 | 369 | 447 | 525 | 603 | 651 | 759 |
|---|---|---|---|---|---|---|---|
| 800 | 20.1 | 14.5 | 11.2 | 8.6 | 6.2 | 4.6 | 0.0 |
| 1200 | 12.5 | 9.3 | 7.2 | 5.5 | 4.0 | 2.9 | 0.0 |
| 1600 | 9.3 | 6.8 | 5.3 | 4.0 | 2.9 | 2.1 | 0.0 |
| 2000 | 7.9 | 5.7 | 4.4 | 3.3 | 2.4 | 1.8 | 0.0 |
| 2400 | 6.0 | 4.5 | 3.5 | 2.6 | 1.9 | 1.4 | 0.0 |
| 2800 | 5.5 | 4.1 | 3.1 | 2.3 | 1.7 | 1.2 | 0.0 |
| 3200 | 4.9 | 3.6 | 2.7 | 2.0 | 1.5 | 1.1 | 0.0 |
| 3600 | 4.1 | 3.0 | 2.2 | 1.7 | 1.3 | 0.9 | 0.0 |
| 4000 | 3.4 | 2.4 | 1.8 | 1.4 | 1.1 | 0.8 | 0.0 |

(mmHg)

(rpm)

PGR VARIATION ON PURGE STARTING TIME

PGR VARIATION BY WATER TEMPERATURE

FULL ADMISSION PURGE RATE MAP

PURGE SOLENOID VALVE CONTROL

FUEL INJECTION QTY. CONTROL

AIR-FUEL RATIO CONTROL APPARATUS OF INTERNAL COMBUSTION ENGINE

BACKGROUND OF THE INVENTION

The present invention relates to an air-fuel ratio control apparatus for an internal combustion engine constructed for sucking evaporated fuel generated in a fuel tank into the intake side of the internal combustion engine so as to burn the evaporated fuel.

There has been an apparatus in which evaporated fuel generated in a fuel tank is stored in a canister, and the evaporated fuel stored in the canister is discharged together with air to a intake side of an internal combustion engine so as to be burnt, in which the quantity of discharged fuel, i.e., canister purge quantity is varied by a fixed value and concentration of the evaporated fuel sucked into the intake side of the internal combustion engine from the canister is detected by the variation of an air-fuel ratio at that time, thereby to correct an air-fuel learning value in accordance with this concentration (e.g., JP-A-2-130240).

In a conventional apparatus described above, however, there is a problem that correct air-fuel ratio learning cannot be sufficiently done since the concentration of the evaporated fuel is high at the initial stage of start of purging, and the variation of an air-fuel feedback value due to the influence by the evaporated fuel becomes larger than the variation of the air-fuel feedback value to be learnt, and the concentration of the evaporated fuel has not yet been detected correctly at the initial stage of the start of purging.

SUMMARY OF THE INVENTION

Thus, it is an object of the present invention to learn an air-fuel ratio correctly even during purge control without being affected by evaporated fuel of high concentration.

Furthermore, it is another object of the present invention to continue purge control so as to improve purge efficiency in a specific operating state even during fuel cut-off.

Accordingly, the present invention provides an air-fuel ratio control apparatus of an internal combustion engine for storing evaporated fuel generated in a fuel tank in a canister and blowing off the evaporated fuel stored in the canister to a intake side of the internal combustion engine through a blow-off passage together with air, provided with:

air-fuel ratio detecting means for detecting an air-fuel ratio of the internal combustion engine;

air-fuel ratio feedback control means for making feedback control of the air-fuel ratio of the air-fuel mixture supplied to the internal combustion engine in accordance with the air-fuel ratio detected by the air-fuel ratio detecting means;

a flow rate control valve for changing a purge rate of air containing the evaporated fuel blown off to the intake side of the internal combustion engine from the canister through the blow-off passage;

purge rate control means for controlling the purge rate by the flow rate control valve in accordance with the state of the engine;

learning value storage means for storing air-fuel learning values;

learning value renewal means for renewing the air-fuel ratio learning values based on the air-fuel ratio feedback value by the feedback control means;

concentration detecting means for detecting the concentration of the evaporated fuel;

purge reacting fuel quantity correcting means for correcting the fuel quantity so that the air-fuel ratio shows a predetermined value in accordance with the evaporated fuel concentration detected by the concentration detecting means and the purge rate by the purge rate control means; and learning inhibiting means for inhibiting renewal of the learning values since purge is started by the flow rate control valve until a predetermined period has elapsed.

With this, the air-fuel ratio learning values of the learning value storage means are renewed by the air-fuel ratio learning value renewal means based on the air-fuel ratio feedback values by the air-fuel ratio feedback means. Further, the concentration of the evaporated fuel is detected by the concentration detecting means, and the fuel quantity is corrected by the purge reacting fuel quantity correcting means so that the air-fuel ratio shows a predetermined value in accordance with the detected evaporated fuel concentration and the purge rate by the purge rate control means. Then, in case a predetermined period of time has not elapsed after the purge by the flow rate control valve is started, the renewal of the air-fuel ratio learning values is inhibited by the learning inhibiting means.

Furthermore, when it is detected to be a fuel cut state by the fuel cut state detecting means, it is determined whether the state is an operating state capable of purging by means of the flow rate control valve by the means for purge rate control during fuel cut. When it is determined to be an operating state capable of purging, it is also possible to control purging by the flow rate control valve even during the fuel cut-off.

DESCRIPTION OF THE PREFERRED EMBODIMENTS

Figure 1:
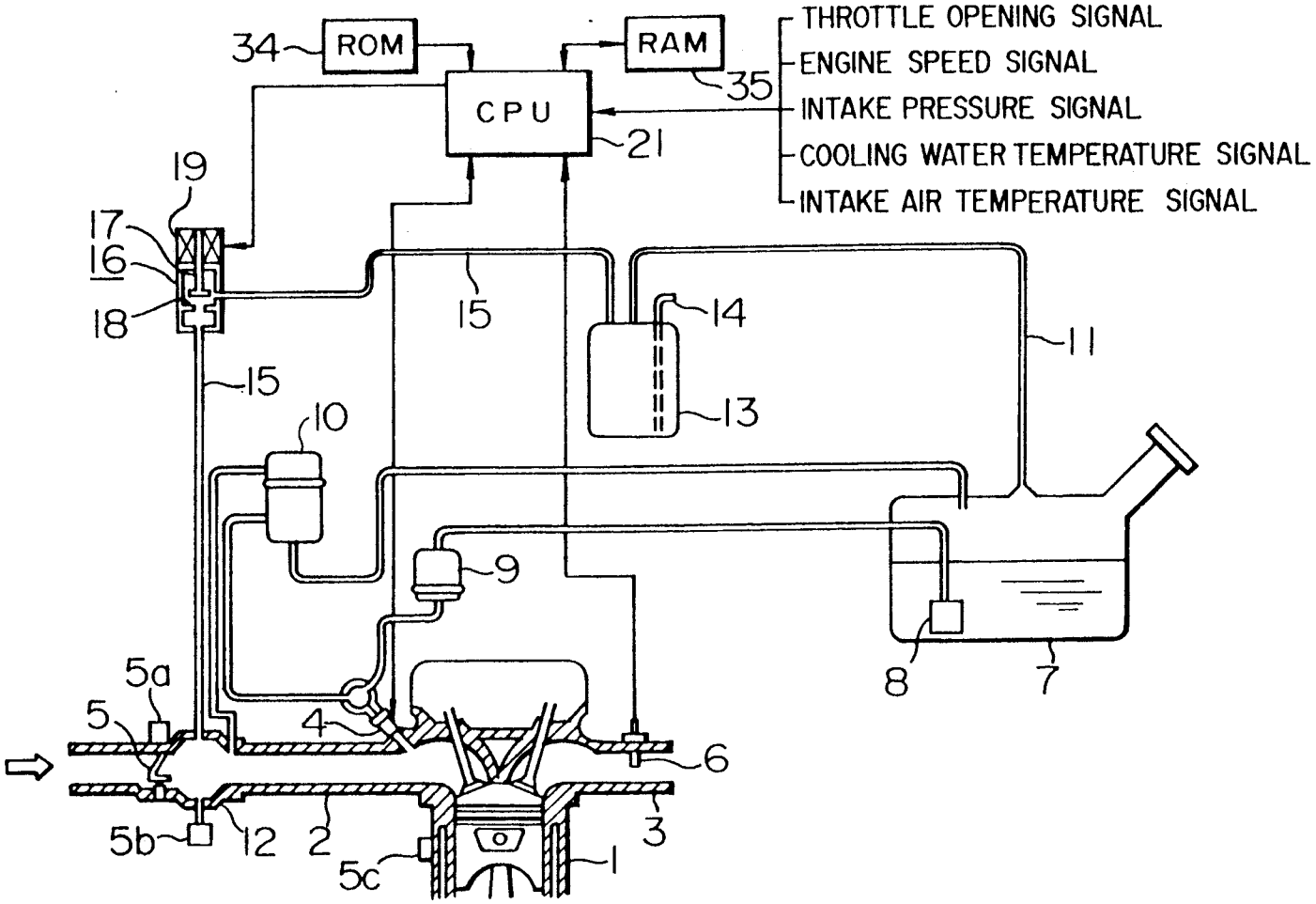
FIG. 1 is a general block diagram showing an embodiment of the present invention.

As shown in FIG. 1, a multi-cylinder engine 1 is mounted on a vehicle, and an intake pipe 2 and an exhaust pipe 3 are connected to the engine 1. An electromagnetic injector 4 is provided at the inner end portion of the intake pipe 2, and a throttle valve 5 is also provided on the upstream side thereof. Furthermore, an oxygen sensor 6 is provided in the exhaust pipe 3 as air-fuel ratio detecting means, and the sensor 6 outputs a voltage signal corresponding to oxygen concentration in the exhaust gas.

A fuel feed system for feeding the fuel to the injector 4 includes a fuel tank 7, a fuel pump 8, a fuel filter 9 and a pressure regulating valve 10. Thus, the fuel (gasoline) in the fuel tank 7 is fed by pressure to the injector 4 of each cylinder through the fuel filter 9 by means of the fuel pump 8, and the fuel fed to each injector 4 is regulated to a predetermined pressure by means of the pressure regulating valve 10.

A purge pipe 11 extending from the top part of the fuel tank 7 is made to communicate with a surge tank 12 of the intake pipe 2, and a canister 13 containing activated charcoal as an adsorbent for adsorbing the evaporated fuel generated in the fuel tank is disposed midway in the purge pipe 11. Further, a hole 14 opening to the atmosphere for introducing fresh air is provided on the canister 13. The purge pipe 11 serves as a bleedoff or discharge passage 15 on the surge tank 12 side of the canister 13, and a variable flow rate electromagnetic valve 16 (hereinafter referred to as a purge solenoid valve) is provided midway in the bleedoff passage 15. In the purge solenoid valve 16, a valve body 17 is always urged toward a direction of closing a seat portion 18 by means of a spring not illustrated, but the valve body 17 opens the seat portion 18 by exciting a coil 19. Thus, the bleedoff passage 15 is closed by demagnetization of the coil 19 of the purge solenoid valve 16, and the bleedoff passage 15 is opened by exciting the coil 19. The opening of the purge solenoid valve 16 is regulated by means of a CPU 21 which is described later by duty ratio control based on pulse width modulation.

Figures 2, 3:
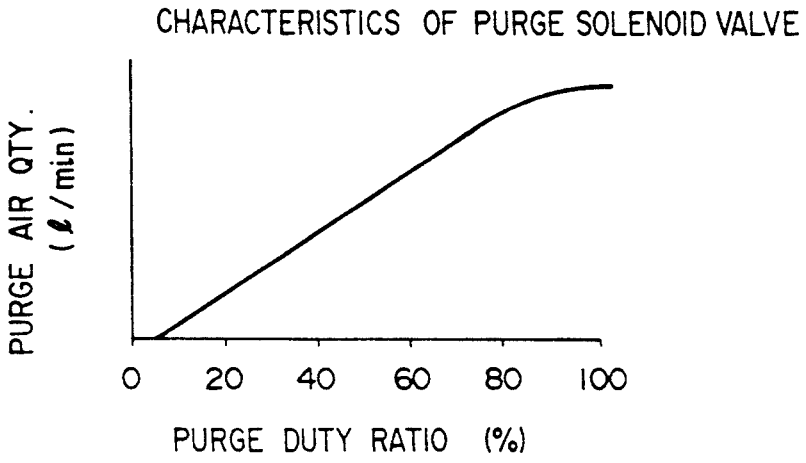
FIG. 2 is a characteristic diagram of a purge solenoid valve in the embodiment.
FIG. 3 is a fully open purge rate map in the embodiment.

Accordingly, when a control signal is applied to the purge solenoid valve 16 from the CPU 21, and the canister 13 is made to communicate with the intake pipe 2 of the engine 1, new air $Q_a$ is introduced from the atmosphere, which ventilates the inside of the canister 13 and is fed into the cylinder through the intake pipe 2 of the engine 1, thus performing canister purge, thereby to recover the adsorbing function of the canister 13. The introduced quantity $Q_p$ (1/min) of the new air $Q_a$ at this time is regulated by changing the duty of a pulse signal applied to the solenoid valve 16 from the CPU 21. FIG. 2 is a characteristic diagram of the purge quantity at this time, and shows the relationship between the duty and the purge quantity of the purge solenoid valve 16 in case a negative pressure in the intake pipe is constant. It is realized from this diagram that, as the purge solenoid is increased from 0%, the purge quantity, i.e., the quantity of air sucked into the engine 1 through the canister 13 increases almost linearly.

The CPU 21 receives a throttle opening signal from a throttle sensor 5*a* for detecting the opening of the throttle valve 5, an engine speed signal from an engine speed sensor not illustrated for detecting the speed of the engine 1, an intake pressure signal from an intake pressure sensor 5*b* (which may be an intake air quantity signal from an intake air quantity sensor) for detecting the pressure of the intake air which has passed through the throttle valve 5, a cooling water temperature signal from a water temperature sensor 5*c* for detecting the temperature of engine cooling water, and an intake temperature signal from an intake temperature sensor not illustrated for detecting the intake air temperature.

Further, the CPU 21 receives a signal (voltage signal) from the oxygen sensor 6, and decides whether the air-fuel mixture is rich or lean. Further, the CPU 21 changes (skips) the feedback correction factor step-wise in order to increase or decrease the fuel injection quantity when rich is inverted to lean or when lean is inverted to rich, and increases or decreases the feedback correction factor gradually in case of rich or lean. Besides, such feedback control is not conducted when the engine cooling water temperature is low and at time of running with a high load and at high engine revolutions. Further, the CPU 21 obtains a basic injection time by the engine speed and the intake pressure, obtains a final injection time TAU by performing correction by a feedback correction factor or the like on the basic injection time, and has fuel injection performed at a predetermined injection timing by the injector 4.

A ROM 34 stores programs and maps for controlling the operation of the whole engine. A RAM 35 temporarily stores various data such as detected data of the opening of the throttle valve 5, an engine speed or the like. Then, the CPU 21 controls the operation of the engine based on the programs in the ROM 34.

FIG. 3 shows a full admission purge rate map, which is determined by an engine speed Ne and a load (which is an intake pipe pressure in this case, and may be an intake air quantity or a throttle opening instead). This map shows a ratio of the air quantity flowing through the bleedoff passage 15 at 100% duty of the purge solenoid valve 16 to the total air quantity flowing into the engine 1 through the intake pipe 2, and is stored in the ROM 34.

The present system is operated through air-fuel ratio feedback (FAF) control, purge rate control, evaporated fuel concentration detection, fuel injection quantity control, air-fuel ratio learning control and purge solenoid valve control.

The operation of the embodiment will be described hereinafter with respect to every control.

Air-fuel Ratio Feedback Control

The air-fuel ratio feedback control will be described with reference to FIG. 4. This air-fuel ratio feedback control is executed in accordance with a base routine of the CPU 21 at intervals of 4 ms.

First, it is determined whether the feedback (F/B) control is possible or not in a step S40. The F/B conditions in this case satisfy all of conditions shown hereunder principally.

That is, (1) not the time of starting, (2) not during fuel cut-off, (3) cooling water temperature (THW)$\geqq$40° C., (4) TAU$>$TAU$_{min}$, and (5) an oxygen sensor being in an activated state.

If these conditions are satisfied, the process proceeds to a step S42, where an oxygen sensor output and a predetermined decision level are compared with each other, and an air-fuel ratio flag XOXR is manipulated with a delay time (H and I msec), respectively. For example, it is assumed to be rich when XOXR=1, and to be lean when XOXR=0. Next, the process proceeds to a step S43, where the value of FAF is manipulated based on XOXR described above. Namely, when XOXR changes from 0 to 1 or from 1 to 0, the value of FAF is made to skip by a predetermined quantity, and while XOXR continues to be 1 or 0, integral control of the FAF value is performed. Then, after the process proceeds to a step S44 and upper and lower limits of the FAF value are checked, the process proceeds to a step S45, where smoothing (averaging) processing is performed every skip or at intervals of predetermined time, thereby to obtain a smoothed value FAFAV. Besides, in case F/B control is not effected in the step S40, the process proceeds to a step S46, where the FAF value is set to 1.0.

Purge Rate Control

Figure 5:
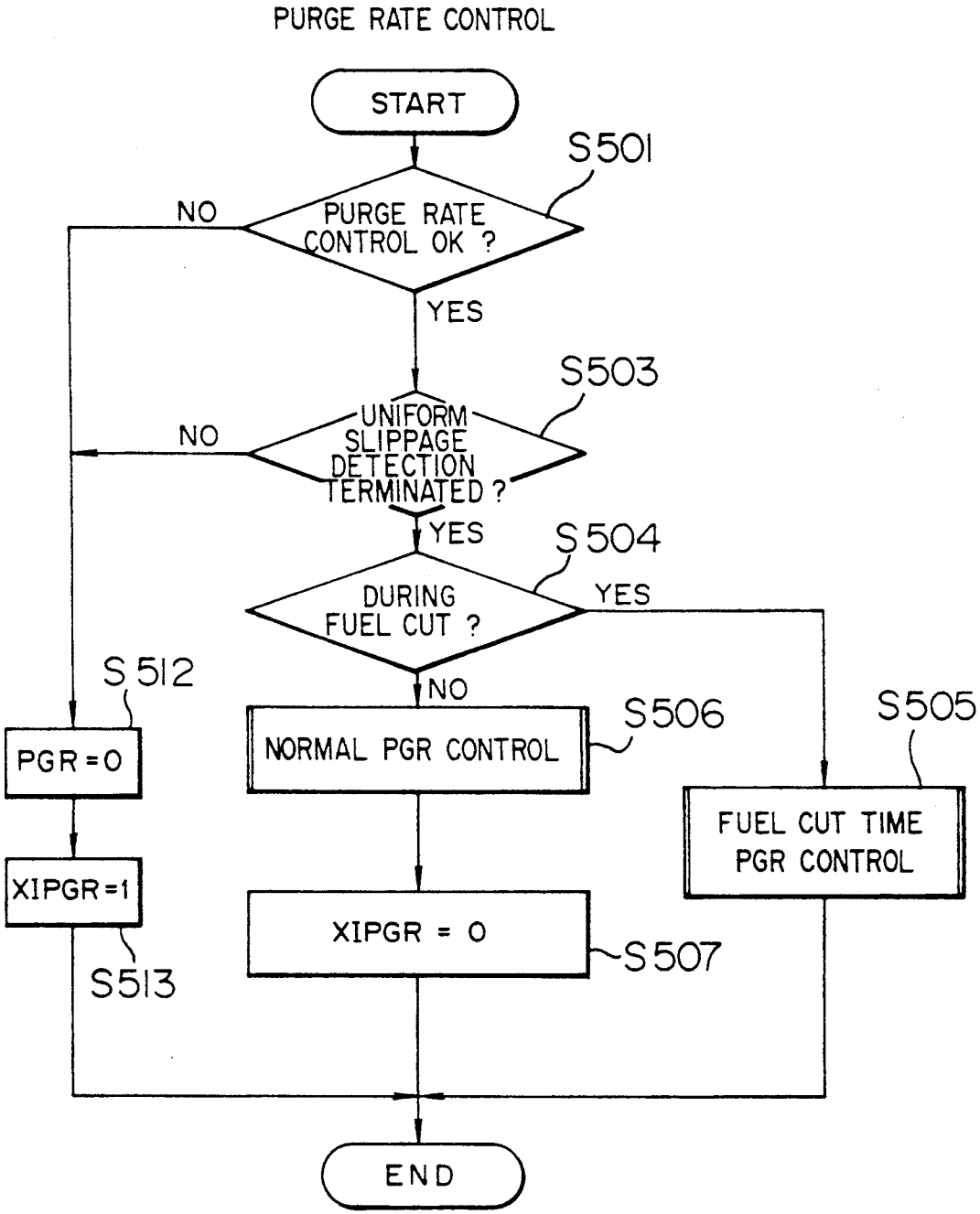
FIG. 5 is a flow chart showing purge rate control in the embodiment.

A main routine of purge rate control is shown in FIG. 5. This routine is also executed every 4 ms in accordance with the base routine of the CPU 21.

It is determined in a step S501 whether purge rate control is possible or not. These purge rate control practicable conditions are to satisfy all of the conditions shown hereunder principally.

That is, (1) not at the time of starting, (2) cooling water temperature (THW)≧50° C., (3) $TAU > TAU_{min}$, and (4) the oxygen sensor 6 being in an activated state.

Figure 13:
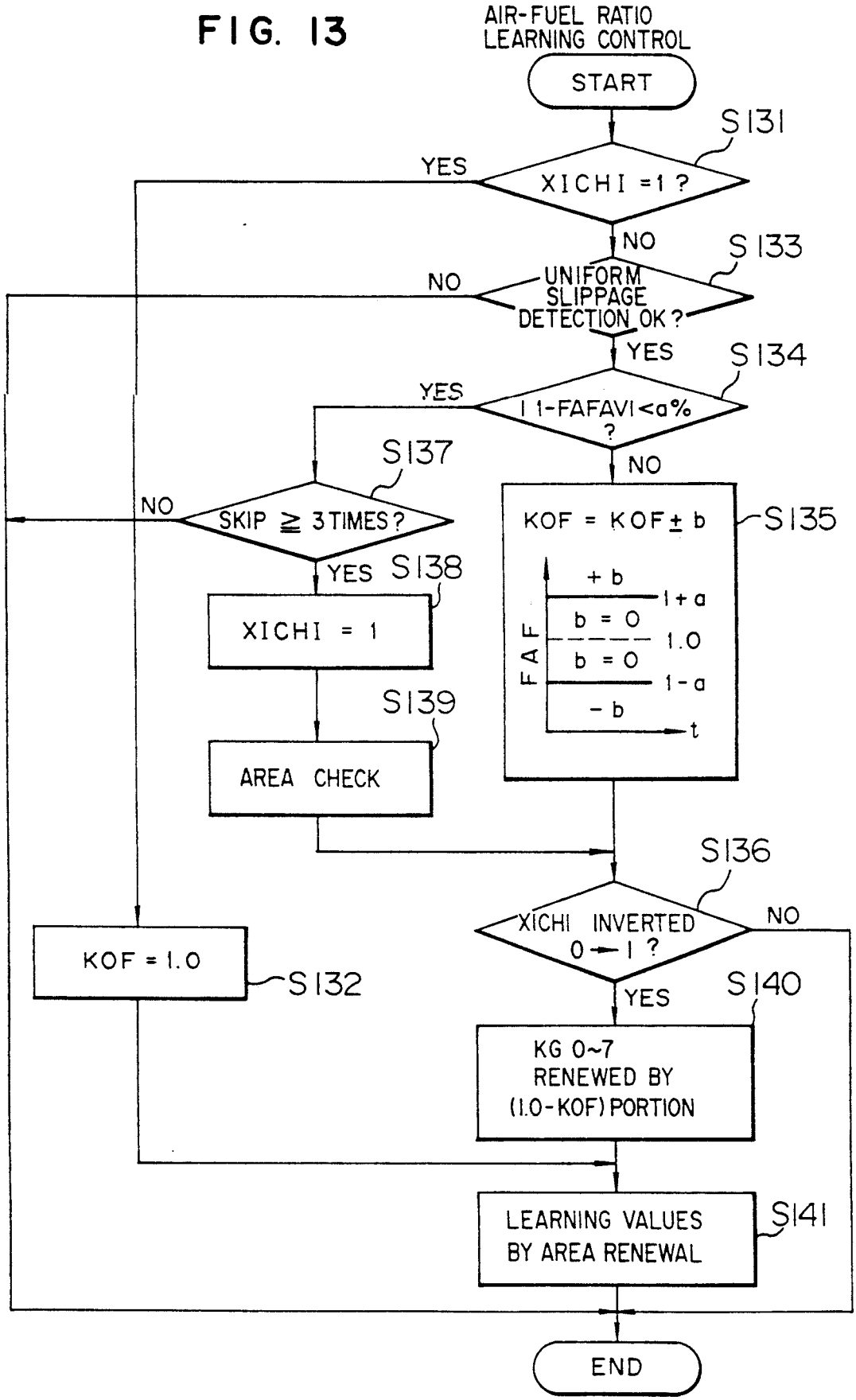
FIG. 13 is a flow chart showing air-fuel ratio learning control in the embodiment.

In a next step S503, it is determined whether uniform slippage detection has been completed or not by checking whether a uniform slippage detection termination flag XICHI shown in FIG. 13 is 1 or not, and it is determined whether fuel cut state or not in a step S504 when it is determined that uniform slippage detection has been terminated, and, in case of during fuel cut, the process proceeds to a step S505 and fuel cut time purge rate (PGR) control is performed. Further, when it is determined in the step S504 that it is not during fuel cut, the process proceeds to a step S506, where normal purge rate control is performed, and a purge unexecuted flag XIPGR is set to 0 in a step S507 thereafter in order to execute purge rate control. Besides, when purge rate conditions are not effected in the steps S501 and S503, the process proceeds to a step S512, where the purge rate is set to 0, and the process proceeds to a step S513 thereafter, where the purge unexecuted flag XIPGR is set to 1.

Figure 6:
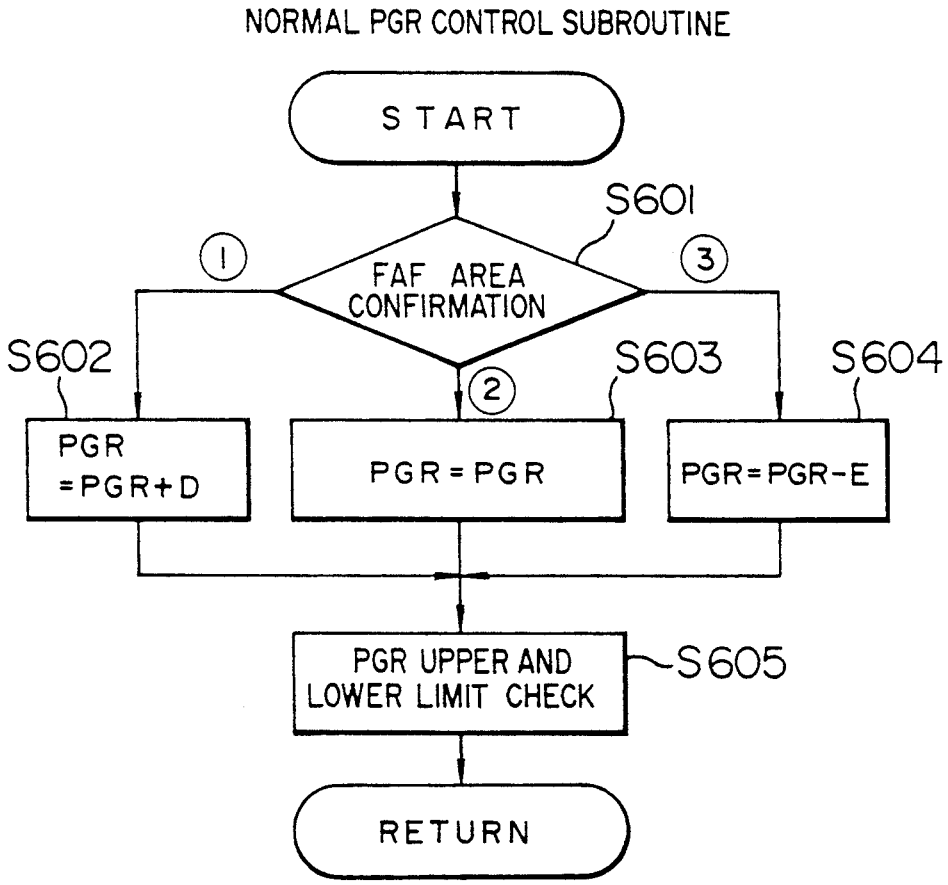
FIG. 6 is a flow chart showing ordinary purge rate control subroutine in the embodiment.
Figure 7A:
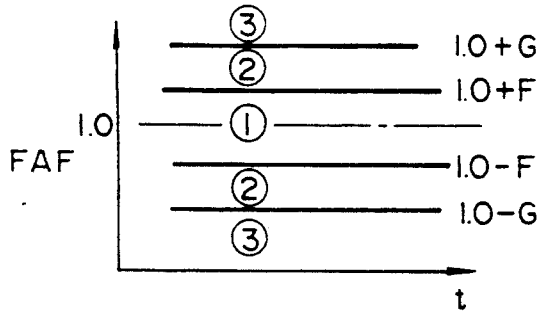
FIGS. 7A to 7E are various characteristic diagrams normally used for purge rate control subroutines in the embodiment.

A normal purge rate control subroutine in a step S506 in FIG. 5 is shown in FIG. 6. First, in a step S601, it is detected in which area among three areas (①,②,③) the FAF value (or a FAF smoothed value) is located with respect to the reference value 1.0. Here, as shown in FIG. 7A, the area ① shows the FAF value is within 1.0±F%, the area ② shows the FAF value is apart at 1.0±F% or more and within ±G% (where, F<G), and the area ③ shows the FAF value is located at 1.0±G% or more.

Figure 7C:
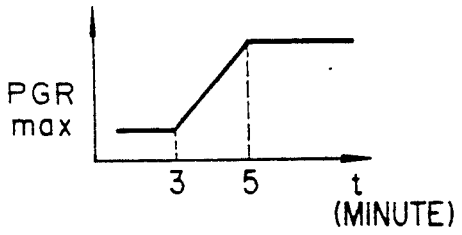
Figure 7B:
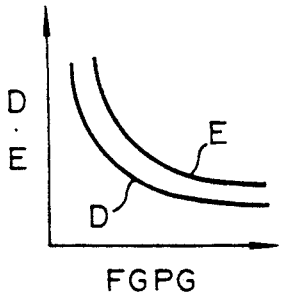
Figure 7D:
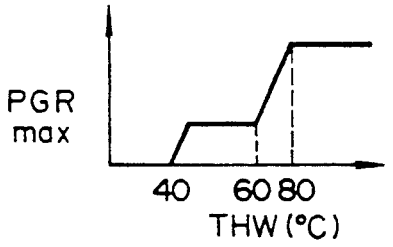
Figure 7E:
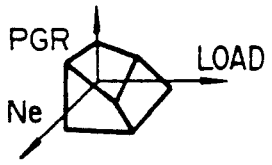

In the case of the area ①, the process proceeds to a step S602, and the purge rate (PGR) is increased by a predetermined value D% at a time. In the case of the area ②, the process proceeds to a step S603, and nothing is changed in PGR. In the case of the area ③, the process proceeds to a step S604, and PGR is reduced by a predetermined value E% at a time. Here, it is desirable to change the predetermined values D and E in accordance with the evaporative concentration (FGPG) as shown in FIG. 7B. Then, upper and lower limits of PGR are checked in a next step S605. Here, the upper limit value shall be of the smallest value among various conditions such as purge starting time shown in FIG. 7C, water temperature shown in FIG. 7D and operating conditions (full admission purge rate map) shown in FIG. 7E.

Figure 8:
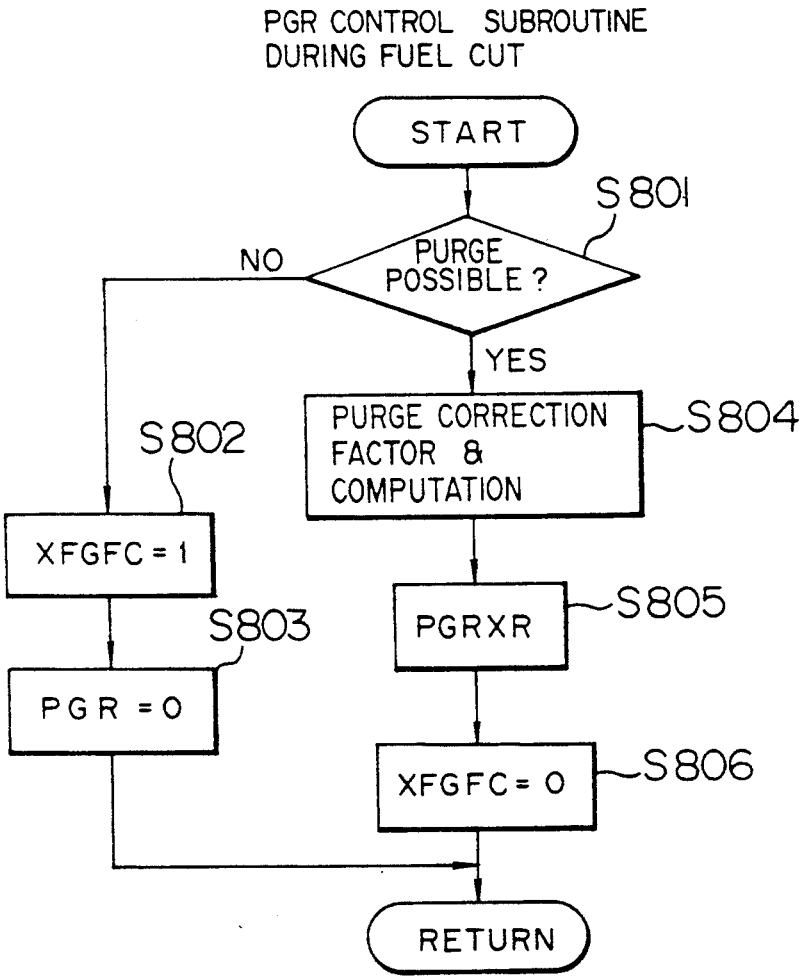
FIG. 8 is a flow chart of a subroutine for purge rate control during fuel cut in the embodiment.

A fuel cut time PGR control subroutine in a step S505 in FIG. 5 is shown in FIG. 8.

First, it is determined in a step S801 whether the state is an operating state capable of purging even during fuel cut. As the operating state capable of purging, it is sufficient that one of the following may be determined. That is, ① when the temperature of an internal combustion engine obtained by detecting exhaust gas temperature, engine oil temperature or the like is at a predetermined value or higher, and the purged evaporated fuel can be purified by means of exhaust purifying catalyzer (not illustrated) in an exhaust pipe passage even if purging is made during fuel cut, and ② when it is determined that the operation of an internal combustion engine is continued for a sufficiently long time or a sufficiently large number of revolutions after purging by the purge solenoid valve 16 is started and a period of time when the evaporative concentration to be purged is deemed to have become sufficiently low has elapsed. Further, when the operating state is determined unpurgeable in the step S801, the process proceeds to a step S802, and a purge stop flag XFGFC is set to 1, and the process proceeds to a step S803 and PGR is set to 0 thereafter.

Figure 9A:
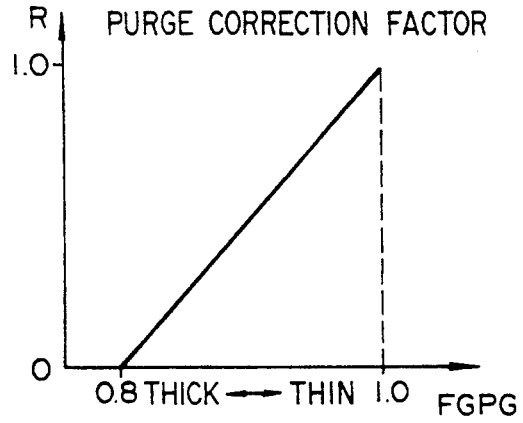
FIGS. 9A and 9B are various characteristic diagrams used for the subroutine for purge rate control during fuel cut in the embodiment.

Further, when it is determined to be an operating state capable of purging in the step S801, the process proceeds to a step S804 and a purge correction factor R is computed. In the step S804, the purge correction factor R which has been set in advance so that the thicker the evaporative concentration gets the smaller the value becomes in accordance with the evaporative concentration FGPG as shown in FIG. 9A is obtained by looking up a table. Otherwise, as shown in FIG. 9A, the purge correction factor R which has been set in advance so that the higher the temperature gets the larger the value becomes in accordance with the temperature of an internal combustion engine such as exhaust gas temperature, engine oil temperature or the like as shown in FIG. 9B is obtained by looking up a table.

Figure 9B:
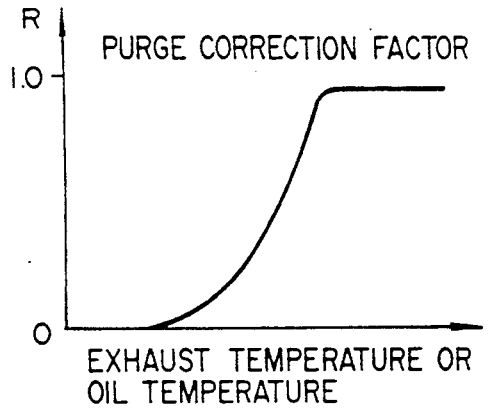

Besides, in case the purge correction factor R is set to 0 when the evaporative concentration reaches a predetermined value or higher or when the internal combustion engine temperature gets to a predetermined value or lower as shown in FIGS. 9A and 9B in the purge correction factor computing step S804, it means that the area capable of purging is also discriminated in this step. Hence, the step S801 may be omitted. Then, after multiplying the purge factor PGR obtained previously in the normal PGR control subroutine shown in FIG. 6 by the purge correction factor R in a next step S805, the process proceeds to a step S806 and the purge stop flag XFGFC is set to 0.

Evaporative Concentration Detection

Figure 10:
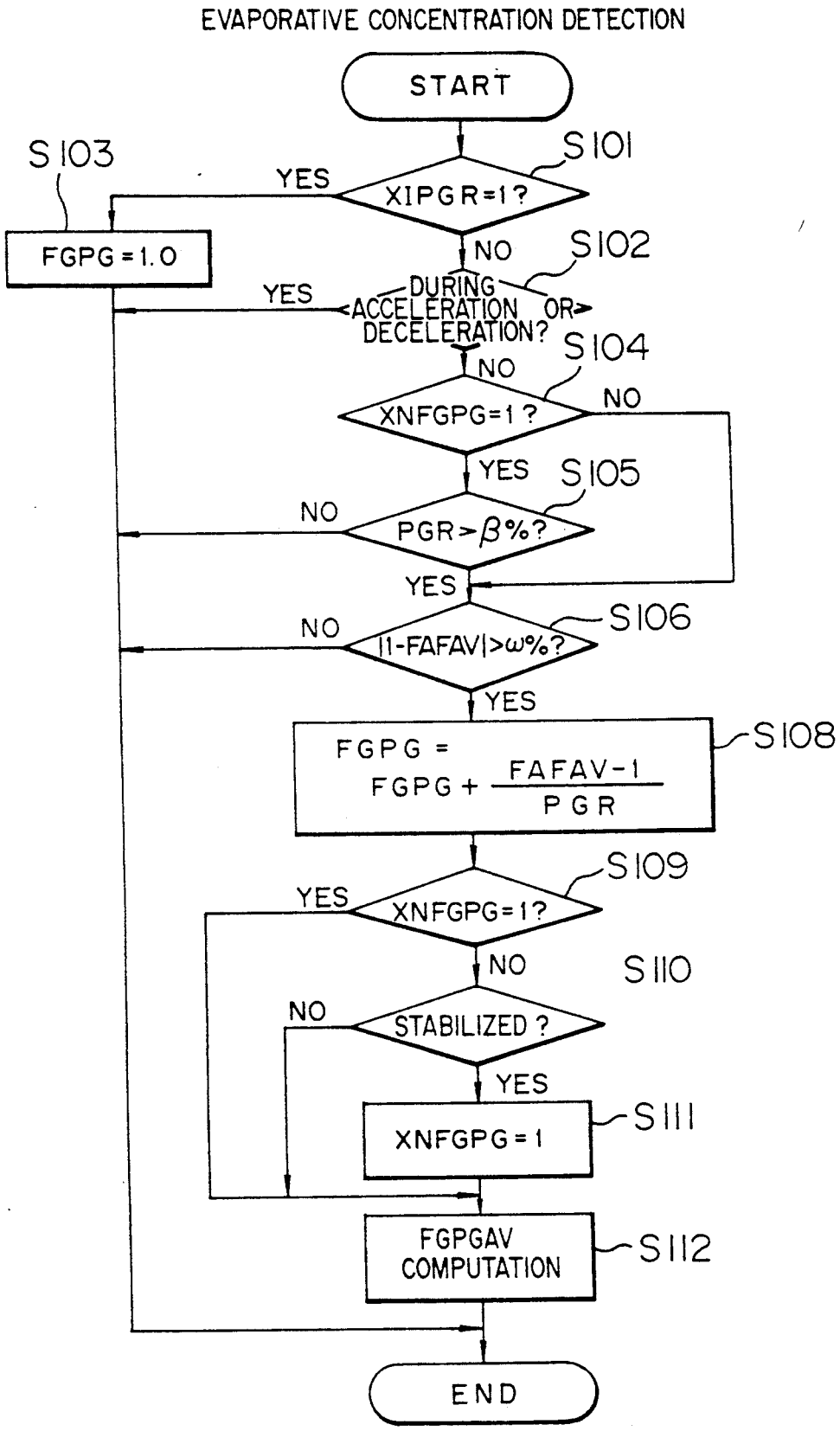
FIG. 10 is a flow chart showing evaporative concentration detection in the embodiment.

A main routine of evaporative concentration detection executed approximately every 4 ms in the base routine of the CPU 21 is shown in FIG. 10. First, when purge control has been started and the purge unexecuted flag XIPGR is not 1 in a step S101, the process proceeds to a step S102, and, when the flag XIPGR is 1 and purge control has not been started as yet, the process proceeds to a step S103 and the evaporative concentration FGPG is set to a reference value 1.0, thus completing the process. Further, it is determined whether during speed adjustment or not in the step S102. Here, determination whether during speed adjustment or not may be made by a generally well known method by detecting an idle switch, throttle valve opening variation, intake pipe pressure variation, vehicle speed or the like.

Further, when it is determined to be during acceleration in the step S102, the process is terminated as it is. When it is determined to be not during acceleration, the process proceeds to a step S104, where it is determined whether an initial concentration detection end flag XNFGPG is 1. When the flag is 1, the process proceeds to a next step S105, and when the flag is not 1, the process proceeds to a step S106 bypassing the step S105. Besides, it is sufficient to initially set this initial concentration detection end flag XNFGPG to 0 when a key switch is turned on. Then, when the initial concentration detection has not been terminated, it is determined in the step S105 whether the purge rate PGR is at a predetermined value ($\beta$%) or higher, and the process is terminated as it is when PGR is not higher than $\beta$% and the process proceeds to a next step S106 when it is higher.

Figure 4:
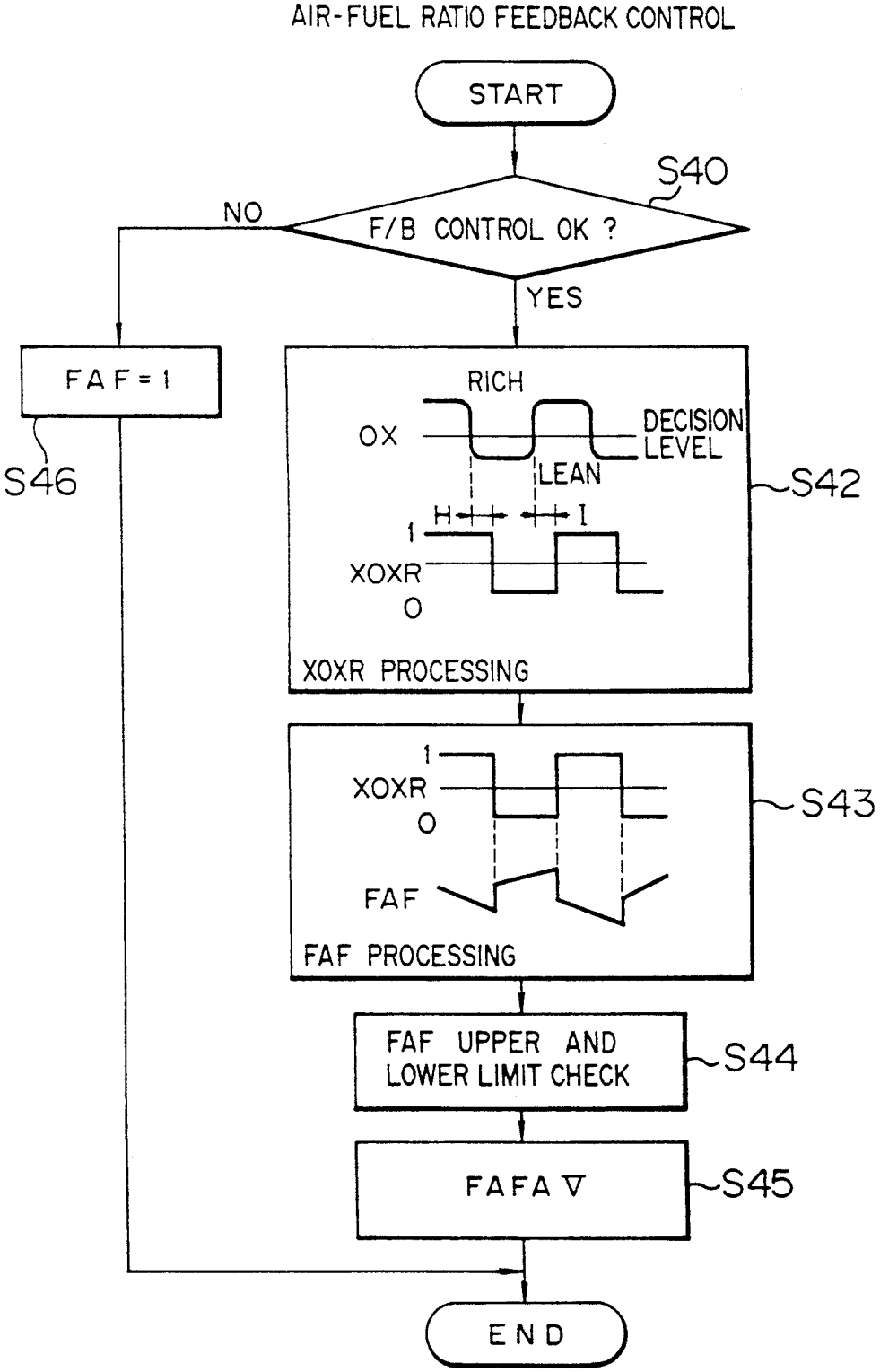
FIG. 4 is a flow chart showing air-fuel ratio feedback control in the embodiment.

In the step S106, it is determined whether the deviation from the reference value 1 of FAFAV obtained in the step S45 in FIG. 4 is at a predetermined value ($\omega$%) or higher, and the process is terminated as it is if it is not higher. When the deviation is more than $\omega$%, the process proceeds to a following step S108 and the evaporative concentration is detected. In the step S108, the evaporative concentration FGPG this time is obtained by adding that obtained by dividing the deviation from the reference value 1 of FAFAV by PGR to the preceding evaporative concentration FGPG. Accordingly, the value of the evaporative concentration FGPG in the present embodiment becomes 1 when the evaporative concentration in the bleedoff passage 15 is 0 (air is 100%), and is set to a value smaller than 1 as the evaporative concentration in the bleedoff passage 15 gets thicker. Here, it may also be arranged so as to obtain the evaporative concentration by replacing FAFAV with 1 in the step S108 shown in FIG. 10 so that the value of FGPG is set to a value larger than 1 as the evaporative concentration gets thicker.

Then, it is determined in a following step S109 whether the initial concentration detection end flag XNFGPG is 1, and the process proceeds to a following step S110 when it is not 1 and the process proceeds to a step S112 bypassing steps S110 and S111 when it is 1. In the step 110, it is determined whether the variation between the preceding detected value and the detected value this time of the evaporative concentration FGPG continues three times or more at a predetermined value ($\theta$%) or below and the evaporative concentration has been stabilized. When the evaporative concentration is stabilized, the process proceeds to the following step S111 and the initial concentration detection end flag XNFGPG is set to 1, and the process proceeds to the next step S112 thereafter. Further, when it is determined in the step S110 that the evaporative concentration has not been stabilized, the process proceeds to a step S112. In this step S112, a predetermined smoothing (e.g., 1/64 smoothing) computation is performed on the evaporative concentration FGPG this time for averaging, thereby to obtain a evaporative concentration mean value FGPGAV.

Fuel Injection Quantity Control

Figure 11:
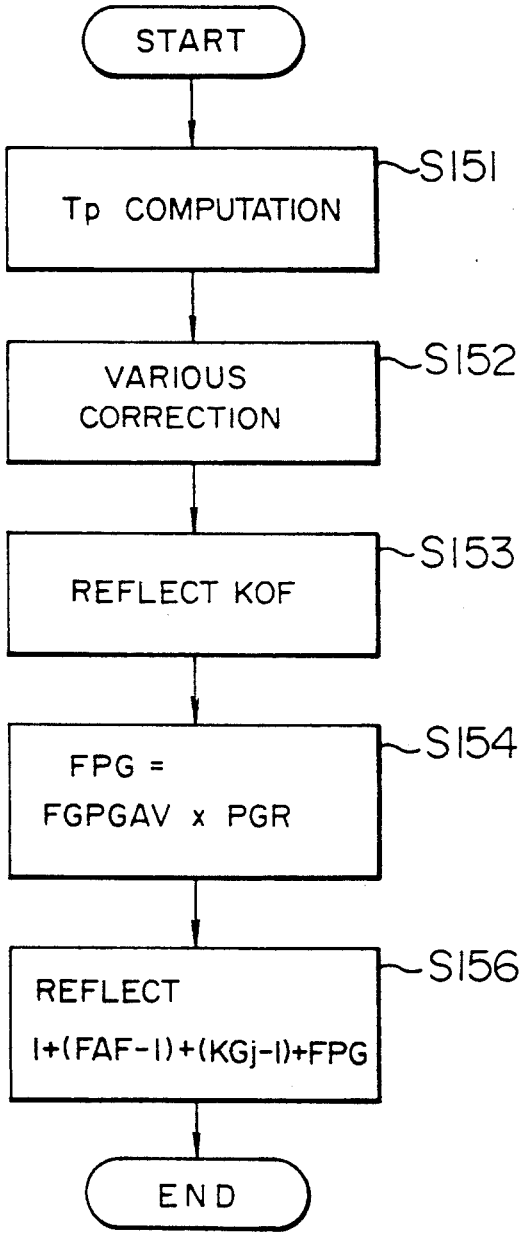
FIG. 11 is a flow chart showing fuel injection control in the embodiment.

Fuel injection control executed approximately every 4 ms in the base routine of the CPU 21 is shown in FIG. 11.

First, a basic fuel injection quantity (TP) is obtained by engine speed and load (such as pressure in the intake pipe) based on the data stored in the ROM 34 as a map in a step S151, and various basic corrections (such as cooling water temperature, after starting and intake air temperature) are made in a following step S152. Next, after reflecting a uniform control fuel correction factor KOF in FIG. 13 which will be described later in a step S153, the process proceeds to a step S154. In this step S154, a purge correction factor FPG is obtained by multiplying the evaporative concentration mean value FGPGAV by the purge rate PGR. Thereafter, in a following step S156, FAF, FPG and air-fuel ratio learning values ($KG_j$) in each engine operating area are obtained as correction factors through the computation of:

$$1+(FAF-1)+(KG_j-1)+FPG$$

thereby to reflect them to the fuel injection quantity TAU.

Purge Solenoid Valve Control

Figure 12:
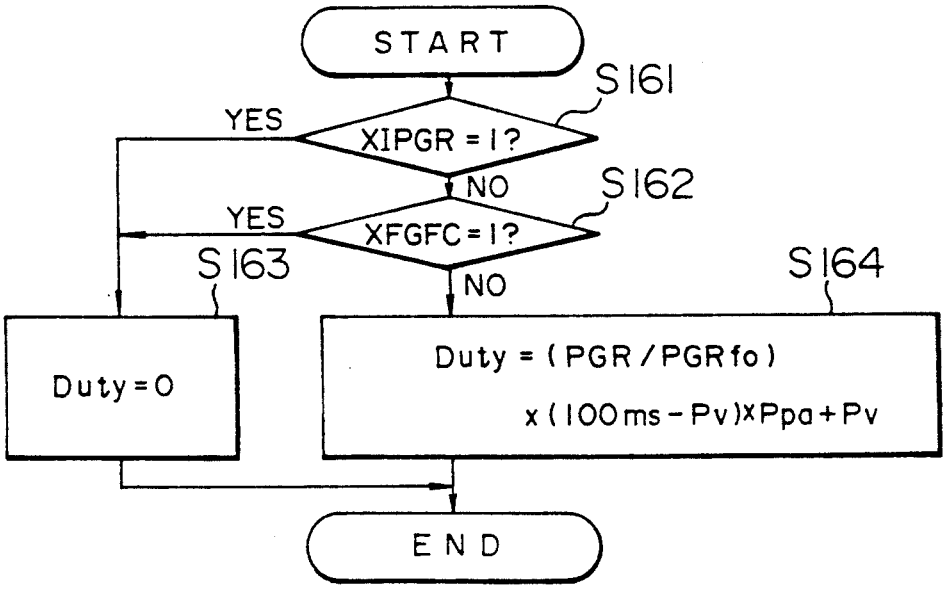
FIG. 12 is a flow chart showing purge solenoid valve control in the embodiment.

A purge solenoid valve control routine executed by time interruption at intervals of 100 ms by the CPU 21 is shown in FIG. 12. When the purge unexecuted flag XIPGR is 1 in a step S161 or when the purge stop flag XFGFC is 1 in a step S162, the process proceeds to a step S163 and Duty of the purge solenoid valve 16 is set to 0. Otherwise, the process proceeds to a step S164, and Duty of the purge solenoid valve 16 is obtained by an operation expression:

$$\text{Duty}=(PGR/PGR_{f0})\times(100\text{ ms}-Pv)\times P_{pa}+Pv$$

assuming that the drive period of the purge solenoid valve 16 is 100 ms. Where, PGR represents the purge rate obtained in FIG. 6 and FIG. 8, $PGR_{f0}$ represents a purge rate in each operating state when the purge solenoid valve 16 is fully opened (see FIG. 3), Pv represents a voltage correction value on the fluctuation of battery voltage, and $P_{pa}$ represents an atmospheric pressure correction value on the fluctuation of the atmospheric pressure.

Air-fuel Ratio Learning Control

Next, an air-fuel ratio learning control routine executed whenever the FAF value skips is shown in FIG. 13. First, it is determined in a step S131 whether a uniform slippage detection end flag XICHI is 1 or not, and the process proceeds to a step S132 in case of 1, and a uniform control fuel correction factor KOF is set to a reference value 1. Here, it is sufficient that the uniform slippage detection end flag XICHI is initially set to 0 when the key switch is put on. Further, when it is determined in the step S131 that the uniform slippage detection end flag XICHI is not 1, the process proceeds to a step S133 and it is determined whether uniform slippage detection is possible.

Here, in the step S133, it is determined that uniform slippage detection is possible when all the basic conditions, i.e., cooling water temperature THW is 50° or higher, increase in quantity after starting is 0, increase in quantity of warming-up is 0, and battery voltage is 11.5 V or higher, are satisfied, and the process proceeds to a step S134 and is terminated as it is in case even any one of these conditions is not satisfied. Then, in the step S134, it is determined whether the deviation from the reference value 1 of FAFAV is at a predetermined value (a%) or below. The process proceeds to a step S135 when the deviation is not below a%, and the uniform control fuel correction factor KOF is corrected by increase or decrease by a predetermined quantity b at a time in accordance with the slippage of the FAF value from the reference value 1 with respect to the preceding uniform control fuel correction factor KOF, and the process proceeds to a step S136 thereafter.

Further, when it is determined in the step S134 that the deviation from the reference value 1 of FAFAV is decreased to a predetermined value (a%) or below by the air-fuel feedback control in FIG. 4 as the result of adjustment of the uniform control fuel correction factor KOF in the step S135, the process proceeds to a step S137 and it is determined whether the FAF value has skipped three times or more. The process is terminated as it is when the FAF value has not skipped three times or more, and the process proceeds to a next step S138 when it has skipped three times or more, and the uniform slippage detection end flag XICHI is set to 1. Thereafter, the process proceeds to a step S139 and the operating area at that time is checked, and the process proceeds to a step S136 thereafter.

In the step S136, it is determined whether the uniform slippage detection end flag XICHI has changed from 0 to 1, and the process is terminated as it is in case of no change and the process proceeds to a step S140 in the case of change, where air-fuel ratio learning values $KG_0$ to $KG_7$ in respective areas are renewed by the deviation portion from the reference value 1 of the uniform control fuel correction factor KOF, and the uniform control fuel correction factor KOF is returned to the reference value 1 thereafter. Here, it may also be arranged so that the renewal quantity of the air-fuel ratio learning values $KG_0$ to $KG_7$ in respective areas are changed by a preset value at a time with the area at time of area check in a step S139 as the center. Further, after termination of the steps S140 and S132, the process proceeds to a step S141 and learning value renewal by area is executed.

Figure 14:
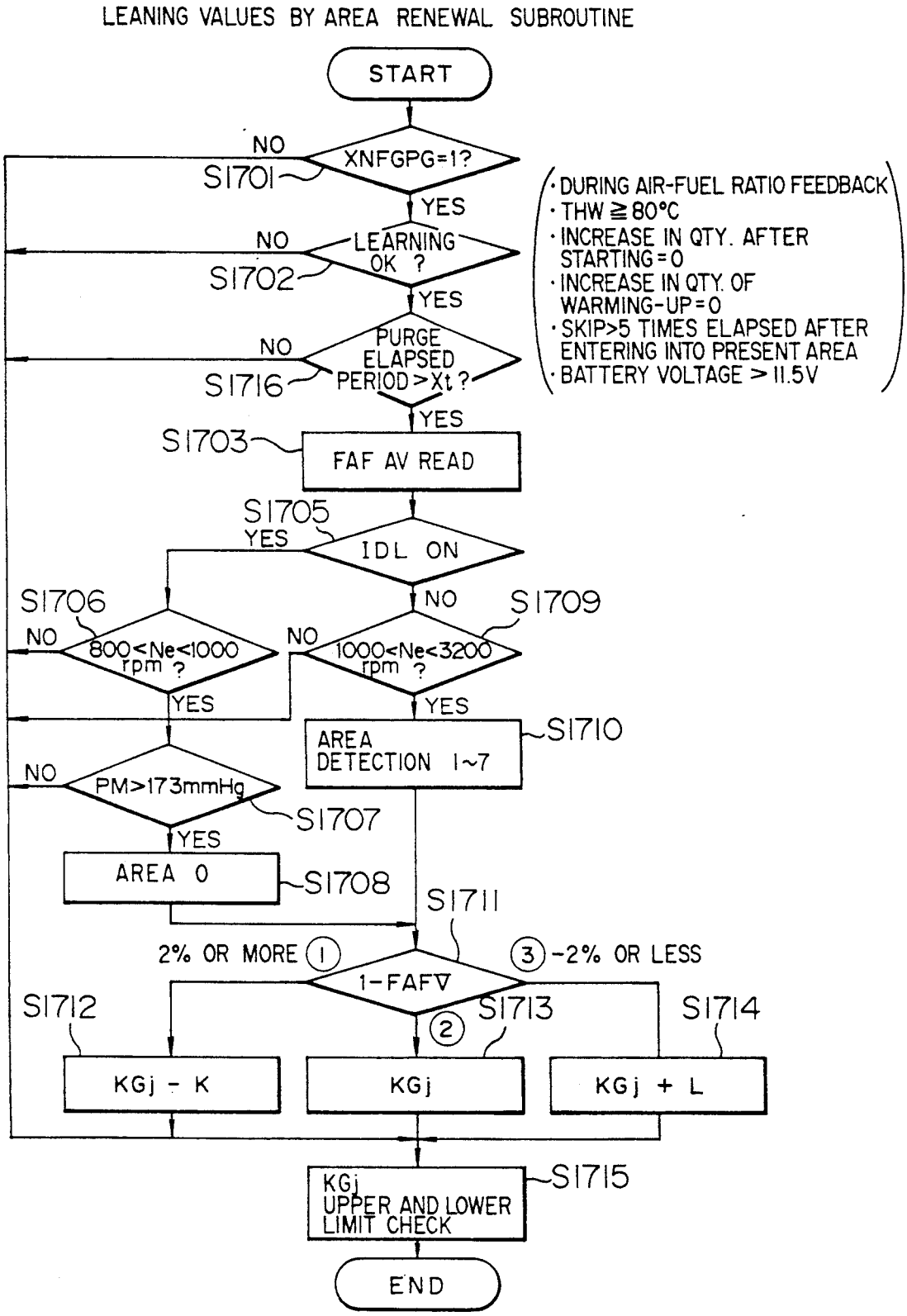
FIG. 14 is a flow chart showing learning value renewal subroutine by range in the embodiment.

Next, a learning value renewal by area sub-routine in a step S141 in FIG. 13 is shown in FIG. 14. First, it is determined in a step S1701 whether an initial concentration detection end flag XNFGPG is 1, and the process is terminated as it is in case XNFGPG is not 1. In case it is 1, the process proceeds to a next step S1702. It is determined in the step S1702 that all of the basic conditions that the cooling water temperature THW is 80° C. or higher, quantity of increase after starting is 0, quantity of increase in warming-up is 0, the FAF value has skipped five times or more after entering into the present operating area, and the battery voltage is 11.5 V or higher are satisfied. The process is terminated as it is when any one of the basic conditions is not satisfied, and the process proceeds to a next step S1716 when all the conditions are satisfied.

In the step S1716, it is determined whether a period of time Xt (e.g., 60 seconds) in which the operation of the internal combustion engine is continued for a sufficiently long time or in a sufficiently large number of revolutions after purging is started by the purge solenoid valve 16, and the evaporative concentration to be purged is deemed to have become sufficiently low has elapsed or not. The process is terminated as it is when the period of time Xt has not elapsed, and learning control by area is performed when the period of time Xt has elapsed.

After the FAFAV value is read in a step S1703, learning control is performed separately for the idle time $KG_0$ (a step S1708) and the running time (a step S1710) depending on the result of determination on idle or not in a step S1705, and is performed separately in a predetermined number (7 for instance) of areas $KG_1$ to $KG_7$ depending on the load (e.g., pressure in the intake pipe) at time of running. Further, the learning value may be renewed in the steps S1706 and S1709 only within a predetermined engine speed (600 to 1,000 rpm at idle time, and 1,000 to 3,200 rpm at running time). Furthermore, the learning value is renewed at idle time in a step S1707 when the intake pipe pressure PM is 173 mmHg or higher.

The method of renewing learning values $KG_0$ to $KG_7$ in respective areas is performed by increasing or decreasing the learning values $KG_0$ to $KG_7$ in these areas by predetermined values ($K\% < L\%$) at a time when the difference between the annealing value FAFAV of FAF and the reference value 1.0 is larger than a predetermined value (2% for instance) (steps S1711 to S1714). Finally, upper and lower limits of $KG_j$ are checked (a step S1715). Here, the upper limit value of $KG_j$ is set to 1.2 and the lower limit value thereof is set to 0.8, and it is also possible to set these upper and lower limit values for every engine operating area. Besides, it is a matter of course that the learning values $KG_0$ to $KG_7$ in respective areas are stored in the RAM 35 (learning value storage means) backed up by a power source so as to hold storage values even after the key switch is disconnected.

Figure 15:
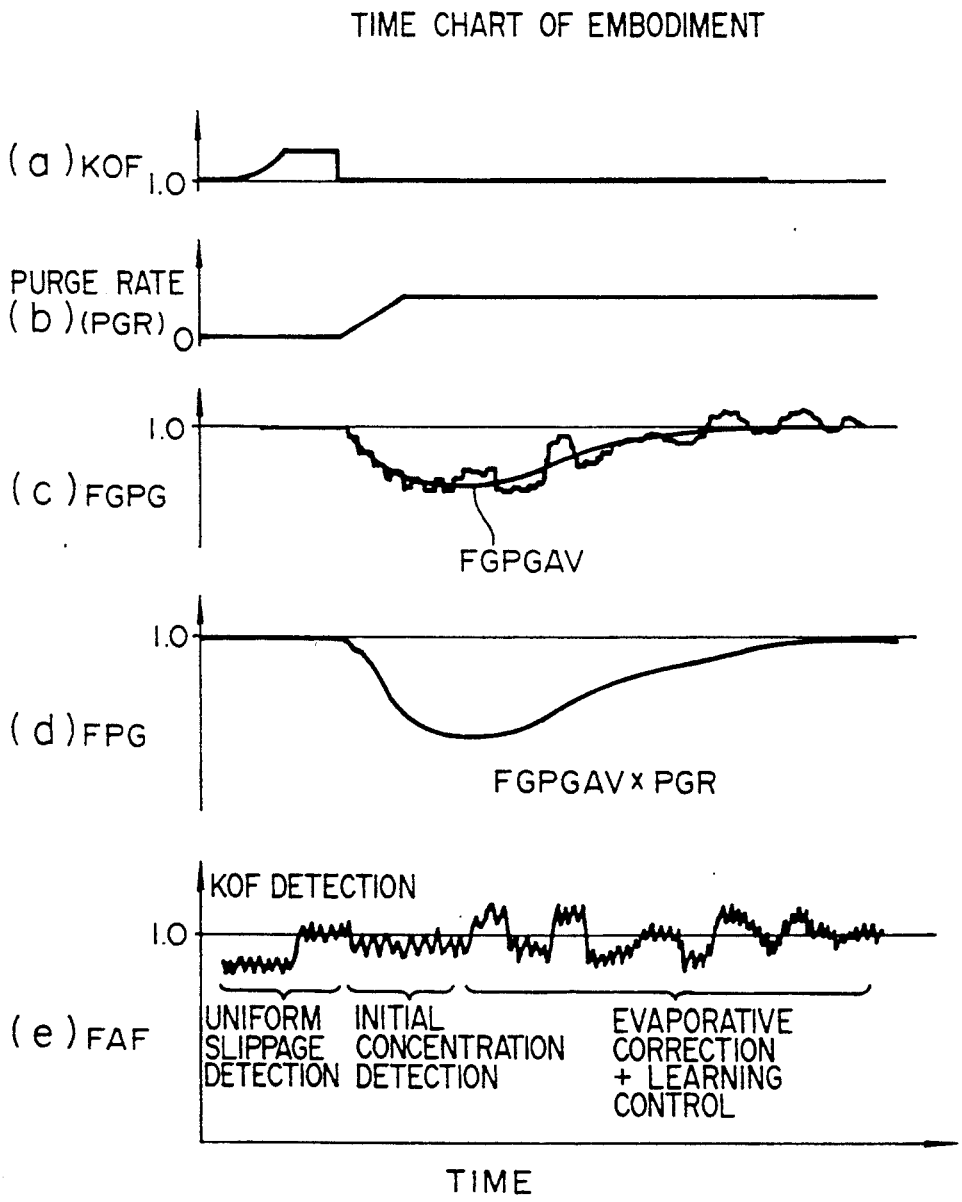
FIGS. 15(*a*) to (*e*) show time charts showing waveforms at respective parts in the embodiment.

A time chart of the above-described embodiment is shown in FIG. 15, wherein (a) shows the uniform control fuel correction factor KOF, (b) shows the purge rate PGR, (c) shows the detected evaporative concentration value FGPG and the smoothing value FGPGAV thereof, (d) shows the fuel loss correction factor FPG, and (e) shows the FAF value. First, after the air-fuel ratio learning values in all regions are renewed by detecting uniform slippage of the air-fuel ratio while increasing or decreasing the uniform control fuel correction factor KOF in a state that the purge rate is set to 0 during air-fuel ratio feedback, the purge rate control is started so as to detect the initial evaporative concentration. Thereafter, while renewing the evaporative concentration, the fuel loss correction factor FPG in accordance with purge control is reflected, and the air-fuel ratio learning values in respective areas are renewed individually after the evaporative concentration FGPG is stabilized and a sufficiently long period of time has elapsed since purging is started.

Further, in the embodiment described above, the learning values in respective areas are renewed by increasing or decreasing the uniform control fuel correction factor KOF so as to detect uniform slippage of the air-fuel ratio. However, it may also be arranged so that a whole area uniform learning value is stored in a RAM separately from those air-fuel ratio learning values in respective areas, and the uniform control fuel correction factor KOF is increased or decreased so as to detect uniform slippage of the air-fuel ratio, thereby to renew a single whole area uniform learning value.

According to the above-mentioned embodiment, step S1716 is provided in FIG. 14 for the start of the learning control per individual area with the detection of a predetermined time or predetermined number of engine revolutions after the purge starting of the purge solenoid valve 16. Alternatively a better air-fuel learning operation can be achieved by integrating flow quantity of evaporated fuel purged into the intake path through bleedoff passage 15 of the engine after the purge starting of the valve 16, and starting the learning control per individual area with detection of the integrated flow quantity of purged fuel larger than a predetermined quantity.

Figure 16:
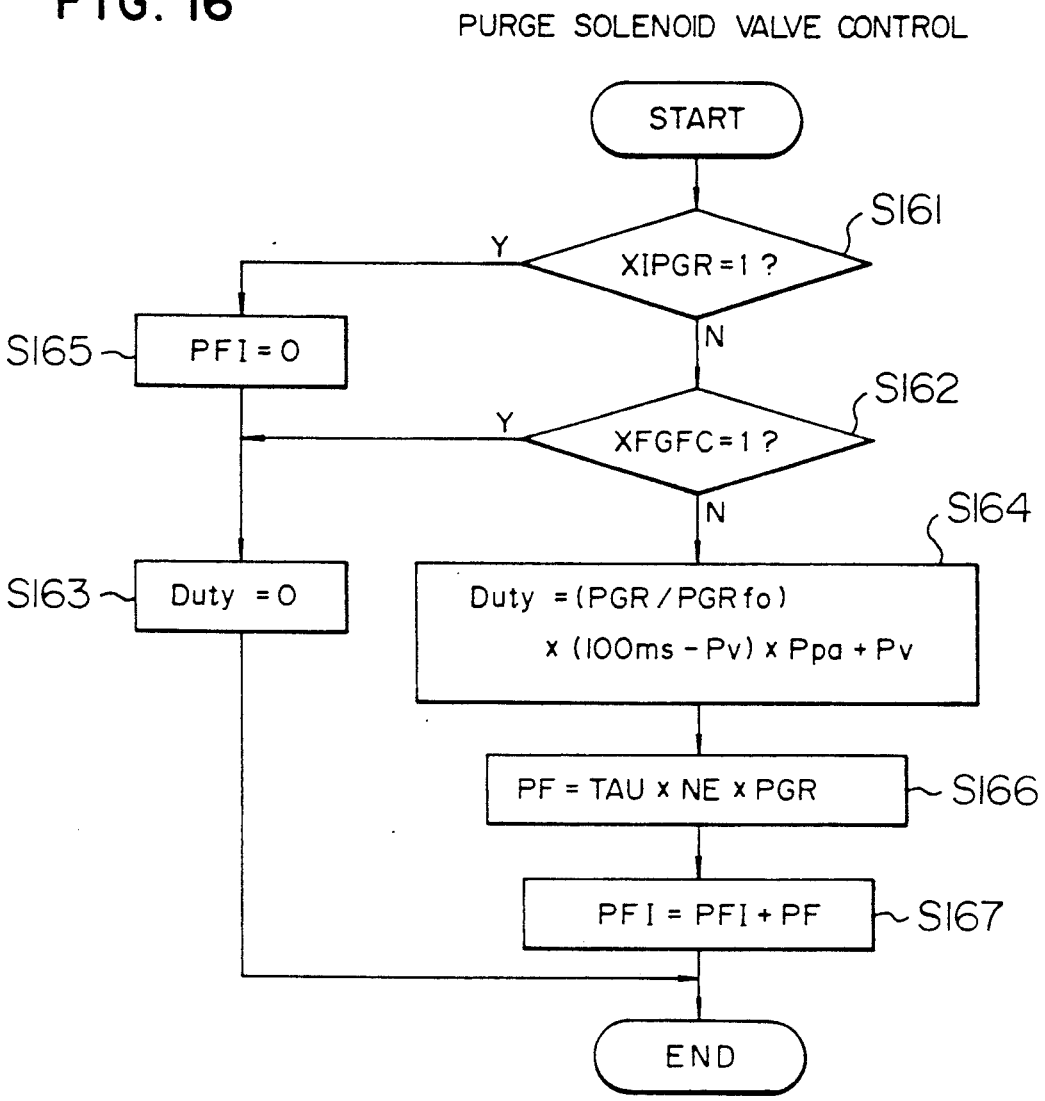
FIG. 16 is a flow chart showing another embodiment of the purge solenoid valve control.

FIG. 16 illustrates an embodiment for performing the integrating operation in the above alternative embodiment. FIG. 16 shows an addition of steps S165 to 167 to purge solenoid valve control routine shown in FIG. 12. Step S165 is added to reset integrated value PFI of purged fuel flow quantity to zero when XIPGR is identified as equal to "1" at step 161. After step 164, step 166 is added to multiply fuel injection quantity TAU, engine speed NE and purge rate PGR in order to determine purge flow quantity PF discharged into engine intake path through bleedoff passage 15. After step 166, step 167 is added to integrate purge flow quantity PF to determine purge flow quantity integration PFI.

Figure 17:
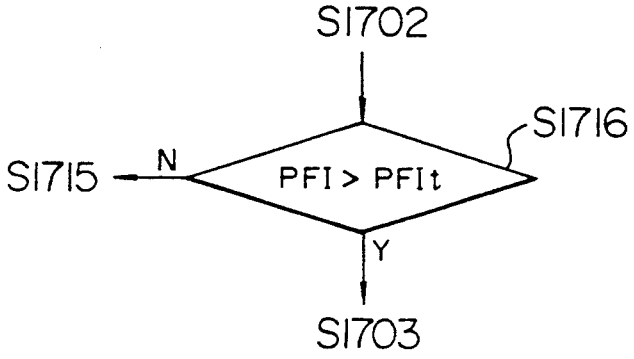
FIG. 17 is a flow chart showing an essential portion of the embodiment shown in FIG. 14.

FIG. 17 shows, instead of step S1716 shown in FIG. 14, step of comparing the integration PFI and a given reference value PFIt, terminating without performing the learning operation per individual area when detecting the integration PFI not larger than the given reference value PFIt, and performing the learning operation per individual area when detecting the integration PFI larger than the value PFIt, which assumes a sufficiently low concentration of evaporated fuel after having a sufficient purge of evaporated fuel after the start of purging operation.

As described above, according to the present invention, the air-fuel ratio learning values of learning value storage means are renewed by air-fuel ratio learning value renewal means based on air-fuel ratio feedback values by the air-fuel ratio feedback means, the concentration of evaporated fuel is detected by concentration detecting means, the fuel quantity is corrected by the purge reacting fuel quantity correction means so that the air-fuel ratio shows a predetermined value in accordance with the detected evaporated fuel concentration and the purge rate by the purge rate control means, and furthermore, when a predetermined period of time has not elapsed after purging by the flow rate control valve is started, renewal of the air-fuel ratio learning value is inhibited by the learning inhibiting means. Accordingly, the present invention has such an excellent effect that it is possible to learn the air-fuel ratio satisfactorily even during purge control without being affected by the evaporated fuel having high concentration.

We claim:

1. An air-fuel ratio control apparatus of an internal combustion engine for storing evaporated fuel generated in a fuel tank in a canister and blowing off the evaporated fuel stored in the canister to an intake side of the internal combustion engine through a blow-off passage together with air, comprising:

air-fuel ratio detecting means for detecting an air-fuel ratio of said internal combustion engine;

air-fuel ratio feedback control means for making feedback control of the air-fuel ratio of the air-fuel mixture supplied to the internal combustion engine in accordance with the air-fuel ratio detected by the air-fuel ratio detecting means;

a flow rate control valve for changing a purge rate of air containing the evaporated fuel blown off to the intake side of said internal combustion engine from said canister through said blow-off passage;

purge rate control means for controlling the purge rate by said flow rate control valve in accordance with the state of the engine;

learning value storage means for storing air-fuel learning values;

learning value renewal means for renewing said air-fuel ratio learning values based on the air-fuel ratio feedback value by said feedback control means;

concentration detecting means for detecting the concentration of said evaporated fuel;

purge reacting fuel quantity correcting means for correcting the fuel quantity so that the air-fuel ratio shows a predetermined value in accordance with the evaporated fuel concentration detected by said concentration detecting means and the purge rate by said purge rate control means; and learning inhibiting means for inhibiting renewal of said learning values once purge is started by said flow rate control valve until a predetermined period has elapsed.

2. An air-fuel ratio control apparatus of an internal combustion engine according to claim 1, further comprising concentration detection inhibit means for detecting at least either a case when the purge rate by said purge rate control means is small or a case when the internal combustion engine is being accelerated or decelerated, and inhibiting concentration detection by said concentration detecting means when the detected purge rate is small or acceleration and deceleration are detected.

3. An air-fuel ratio control apparatus of an internal combustion engine according to claim 1, further comprising:

smoothing means for smoothing feedback values of the air-fuel ratio by said air-fuel ratio feedback control means; and deviation detecting means for detecting the deviation from a reference value of the output of said smoothing means when the purge rate is being controlled by said purge rate control means; wherein:

said concentration detecting means includes means for detecting the concentration of said evaporated fuel by the deviation from the reference value detected by said deviation detecting means and the purge rate of said purge rate control means.

4. An air-fuel ratio control apparatus of an internal combustion engine according to claim 3, wherein said learning value storage means stores learning values of the air-fuel ratio in accordance with a plurality of operating areas of an internal combustion engine and further comprises:

uniform learning value control means for setting said purge rate to zero and increasing or decreasing fuel quantity so that the deviation from the reference value detected by said deviation detecting means shows a predetermined value or below during execution of air-fuel feedback by said air-fuel ratio feedback control means;

uniform learning value renewal means for renewing learning values in all areas of said learning value storage means based on fuel increase or decrease quantity of said uniform learning value control means when said deviation shows a predetermined value or below by increase and decrease of fuel quantity by the uniform learning value control means;

purge start permit means for permitting start of purge rate control by said purge rate control means after renewal of learning values by the uniform learning value renewal means; and learning value renewal by area means for renewing learning values of said learning value storage means by area based on air-fuel ratio feedback values by said air-fuel ratio feedback control means in a state that start of purge rate control by said purge rate control means is permitted by said purge start permit means.

5. An air-fuel ratio control apparatus of an internal combustion engine according to claim 4, further comprising learning condition determining means for determining at least one of whether an initial concentration is being detected by said concentration detecting means or the detected concentration value by said concentration detecting means is stabilized, and permitting renewal of learning values by said learning value renewal by area means when it is determined that said initial concentration is not being detected or said detected concentration value is stabilized.

6. An air-fuel ratio control apparatus of an internal combustion engine according to claim 1, further comprising:

fuel cut state detecting means for detecting a fuel cut state of an internal combustion engine; and means for purge rate control during fuel cut for determining, when it is detected to be said fuel cut state by the fuel cut state detecting means, whether the state is an operating state capable of purging by said flow rate control valve, and for controlling purging by said flow rate control valve even during said fuel cut when it is determined to be an operating state capable of purging.

7. An air-fuel ratio control apparatus of an internal combustion engine according to claim 6, wherein said means for purge rate control during fuel cut includes operating state discriminating means for discriminating at least one of whether the temperature of said internal combustion engine is at a predetermined value or higher, whether the elapsed period of time after purging by said flow rate control valve has been started has a predetermined value or more, and whether the detected concentration value by said concentration detecting means is at a predetermined value or below, and means for determining to be an operating state capable of purging when it is discriminated by the operating state discriminating means to be one of those that the temperature of said internal combustion engine is at a predetermined value or higher, the elapsed period of time after purging by said flow rate control valve is started is at a predetermined value or longer, or said detected concentration value is at a predetermined value or lower.

8. An air-fuel ratio control apparatus of an internal combustion engine according to claim 7, wherein said means for purge rate control during fuel cut includes means for changing said purge rate by said flow rate control valve in accordance with said engine temperature or said, detected concentration value discriminated by said operating state discriminating means.

9. An air-fuel ratio control apparatus according to claim 1, wherein said purge reacting fuel quantity correcting means includes means for smoothing concentration of evaporated fuel detected by said concentration detecting means, and means for correcting the fuel quantity for the detection of a predetermined air-fuel ratio in response to the smoothed concentration of evaporated fuel and said purge rate.

10. An air-fuel ratio control apparatus according to claim 1, wherein said learning inhibiting means includes integration means for integrating purge flow quantity of evaporated fuel discharged in engine intake path through said discharge path after start of evaporated fuel purge of said flow rate control valve, and means for releasing the inhibition of said renewal of learning values by detecting the integrated purge flow quantity of evaporated value larger than a predetermined quantity.

* * * * *